US011420450B2

(12) United States Patent
Maeyama et al.

(10) Patent No.: US 11,420,450 B2
(45) Date of Patent: Aug. 23, 2022

(54) PRINTING APPARATUS

(71) Applicants: Yuichiro Maeyama, Kanagawa (JP); Yohei Sakon, Kanagawa (JP); Shingo Takai, Ibaraki (JP); Noboru Hirano, Kanagawa (JP); Dai Kurabayashi, Kanagawa (JP)

(72) Inventors: Yuichiro Maeyama, Kanagawa (JP); Yohei Sakon, Kanagawa (JP); Shingo Takai, Ibaraki (JP); Noboru Hirano, Kanagawa (JP); Dai Kurabayashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 15 days.

(21) Appl. No.: 17/092,852

(22) Filed: Nov. 9, 2020

(65) Prior Publication Data

US 2021/0146701 A1 May 20, 2021

(30) Foreign Application Priority Data

Nov. 20, 2019 (JP) ..... JP2019-209433

(51) Int. Cl.
*B41J 29/38* (2006.01)
*B41J 11/00* (2006.01)
*B65H 7/02* (2006.01)

(52) U.S. Cl.
CPC ..... *B41J 11/0095* (2013.01); *B41J 11/008* (2013.01); *B41J 11/0045* (2013.01); *B65H 7/02* (2013.01)

(58) Field of Classification Search
None
See application file for complete search history.

(56) References Cited

U.S. PATENT DOCUMENTS

| | | | | |
|---|---|---|---|---|
| 2019/0161301 | A1 | 5/2019 | Maeyama et al. | |
| 2019/0171154 | A1* | 6/2019 | Kobayashi | B65H 5/062 |
| 2019/0283398 | A1 | 9/2019 | Maeyama et al. | |
| 2019/0283992 | A1 | 9/2019 | Maeyama | |
| 2020/0165088 | A1 | 5/2020 | Maeyama | |

FOREIGN PATENT DOCUMENTS

| | | |
|---|---|---|
| JP | 2006-264900 | 10/2006 |
| JP | 2013-235166 | 11/2013 |
| JP | 2019-155749 | 9/2019 |
| JP | 2019-155794 | 9/2019 |

* cited by examiner

*Primary Examiner* — Erica S Lin
*Assistant Examiner* — Tracey M McMillion
(74) *Attorney, Agent, or Firm* — Duft & Bornsen, PC

(57) ABSTRACT

A printing apparatus includes a printing device to print, on a sheet, a detection mark for acquiring an amount of deviation of an image, a detection device to read a position of the detection mark and acquire the amount of deviation of the position of the detection mark, and control circuitry to perform correction according to the amount of deviation. The circuitry prints the detection marks on both faces of the sheet in duplex printing, reads the detection marks on both faces with the detection device, calculates a first correction value from the position of the detection mark on a first face on which printing is performed first, calculates a second correction value from the position of the detection mark on a second face on which printing is performed later, and calculates a third correction value from the positions of the detection marks on the first and second faces.

13 Claims, 6 Drawing Sheets

PRINTING APPARATUS

CROSS-REFERENCE TO RELATED APPLICATIONS

This patent application is based on and claims priority pursuant to 35 U.S.C. § 119(a) to Japanese Patent Application No. 2019-209433, filed on Nov. 20, 2019, in the Japan Patent Office, the entire disclosure of which is incorporated by reference herein.

BACKGROUND

Technical Field

Aspects of the present disclosure relate to a printing apparatus.

Related Art

A printing apparatus such as an image forming apparatus corrects, for example, a deviation between an input image and an output image or a deviation between images of the front face and the back face of a recording medium due to expansion and contraction of the printing medium during printing.

SUMMARY

In an aspect of the present disclosure, there is provided a printing apparatus that includes a printing device to print, on a sheet, a detection mark for acquiring an amount of deviation of an image generated when printing is performed, a detection device to read a position of the detection mark and acquire the amount of deviation of the position of the detection mark, and control circuitry to perform correction according to the amount of deviation when printing is performed. The control circuitry prints the detection marks on each of a first face and a second face of the sheet with the printing device in a duplex printing, reads the detection mark of each of the first face and the second face with the detection device, calculates a first correction value from the position of the detection mark on the first face on which printing is performed first, calculates a second correction value from the position of the detection mark on the second face on which printing is performed after the first face, and calculates a third correction value from the position of the detection mark on the first face and the position of the detection mark on the second face.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
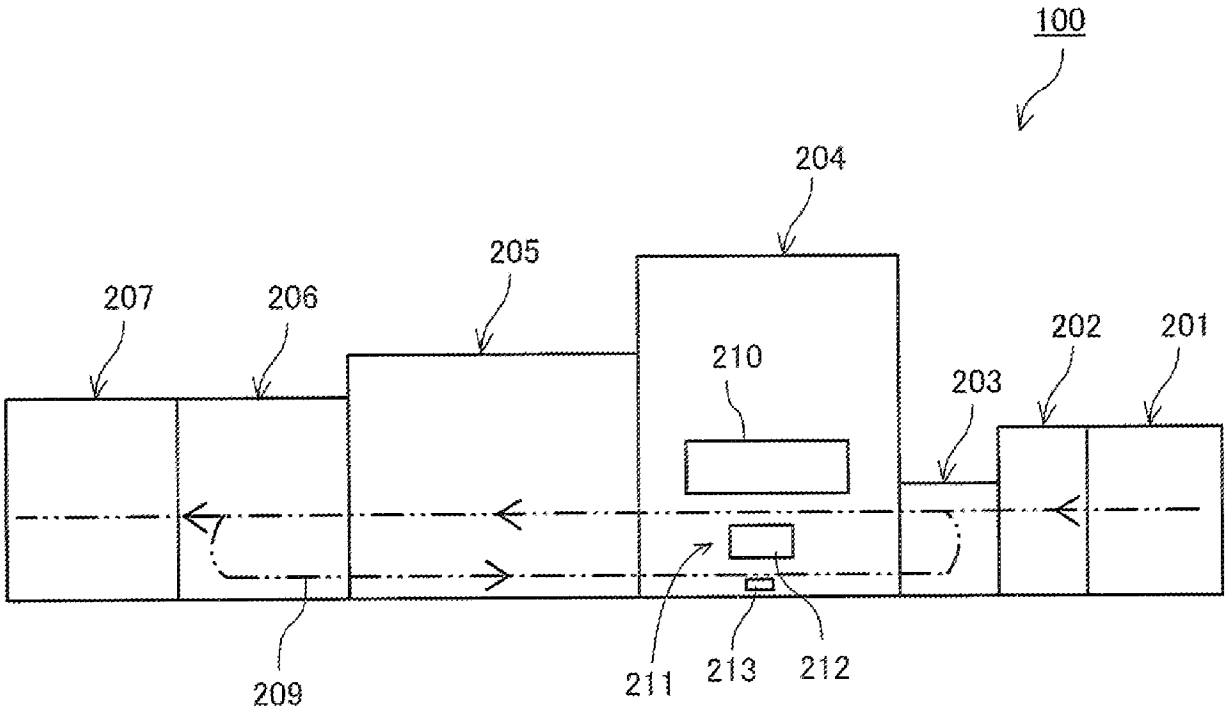
FIG. 1 is an illustration of a printing apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

First, a first embodiment of the present disclosure is described according to FIG. 1. FIG. 1 is an illustration of a printing apparatus according to the first embodiment of the present disclosure.

A printing apparatus (or an image forming system) 100 includes a carry-in unit 201, a pre-applying unit 202, a registration unit 203, a printing unit 204, a drying unit 205, a cooling unit 206, and a carry-out unit 207.

The carry-in unit 201 stores a sheet P which is a processed object (i.e., an object to be conveyed), and delivers the sheet P to the printing unit 204 and so forth at the subsequent stage. An example of the sheet P is a sheet of paper but is not limited to the sheet of paper. Examples of the sheet P include any image printable medium such as coated paper, thick paper, an overhead projector (OHP) sheet, a plastic film, and a copper foil.

In the present embodiment, the sheet P on which an image is formed is treated as a processing object (i.e., an object to be conveyed), but it is not limited thereto. For example, a sheet that is not an object for image formation, such as prepreg, may be treated as the processing object.

The pre-applying unit 202 coats a pre-applying liquid on the sheet P that is the processing object (i.e., the object to be conveyed) delivered from the carry-in unit 201. As a result, ink as the liquid that is applied by the printing unit 204 can be adapted to a different type of sheet P. Note that, in some embodiments, a printing apparatus may include no pre-applying unit.

The registration unit 203 is a unit that conveys the sheet P to the printing unit 204 and adjusts the conveying timing or the position of the sheet P.

The printing unit 204 includes an image forming unit 210 that is a printing device to print by an inkjet method, and applies ink on the sheet P to form an image. The printing unit 204 can print a position detection mark as an output image and a detection image that are instructed by a user to be printed on the sheet P. Note that the printing unit 204 may adopt an electrophotographic printing device, instead of the inkjet printing device.

The drying unit 205 dries the ink applied to the sheet P by the printing unit 204.

The cooling unit 206 cools the sheet P heated by the drying unit 205.

In the case of a single-side printing, the cooling unit 206 conveys the sheet P on which the image is formed to the carry-out unit 207 at the subsequent stage. On the other hand, in the case of duplex printing, the cooling unit 206 conveys the sheet P on which the image is formed to a reverse passage 209.

The reverse passage 209 inverts and conveys the front face (one face) and the back face (the other face) of the sheet P by switching back the conveyed sheet P. The sheet P conveyed by the reverse passage 209 is reconveyed to the printing unit 204 via the registration unit 203. Then, the printing unit 204 forms an image on the face opposite the face on which the image has been formed in the previous time. The sheet P is dried and cooled by the drying unit 205 and the cooling unit 206, and conveyed as a printed material to the carry-out unit 207 at the subsequent stage.

The carry-out unit 207 receives the ejection of the sheet P on which the image has been formed via the printing unit 204, the drying unit 205, and the cooling unit 206.

Further, the printing unit 204 includes the detection device 211 including an image reader to detect the position of an image recorded on the sheet P or an end of the sheet P conveyed, to correct the relative positions of pixels between a plurality of reading devices 212 and the relative position of each pixel of one reading device 212.

The detection device 211 includes the reading device 212 as a reader and a position reference member 213.

The reading device 212 includes, for example, a contact image sensor (CIS) in which a plurality of image pick-up devices (e.g., complementary metal oxide semiconductor (CMOS) image sensors) arranged in line(s). The reading device 212 receives reflected light from a reading object and outputs an image signal. Specifically, the reading device 212 reads, as the reading object, the conveyance position of the sheet P on which the image has been formed by the printing unit 204 and the image formation position on the sheet P. Further, the reading device 212 reads the position reference member 213 as the reading object.

Generally, the CIS applied to the reading device 212 is known to have a configuration in which a plurality of sensor chips having a plurality of pixels are arranged in a main scanning direction to secure a required effective reading length in the main scanning direction.

If the position reference member 213 expands or contracts due to the influence of heat generation of peripheral devices, the position reference member 213 might not function as an absolute position reference, resulting in deterioration of the position detection accuracy. Therefore, the position reference member 213 is made of a material that has a lower coefficient of linear expansion than the substrate of the reading device 212 and a negligibly small amount of expansion or contraction due to the influence of ambient temperature.

In the present embodiment, the position reference member 213 is made of glass in view of the assumed range of temperature change and coefficient of linear expansion. The material of the position reference member 213 is not limited to glass, and it is preferable to use, e.g., quartz glass to achieve highly accurate media position detection when the temperature change range of the reading device 212 is wide.

Figure 2:
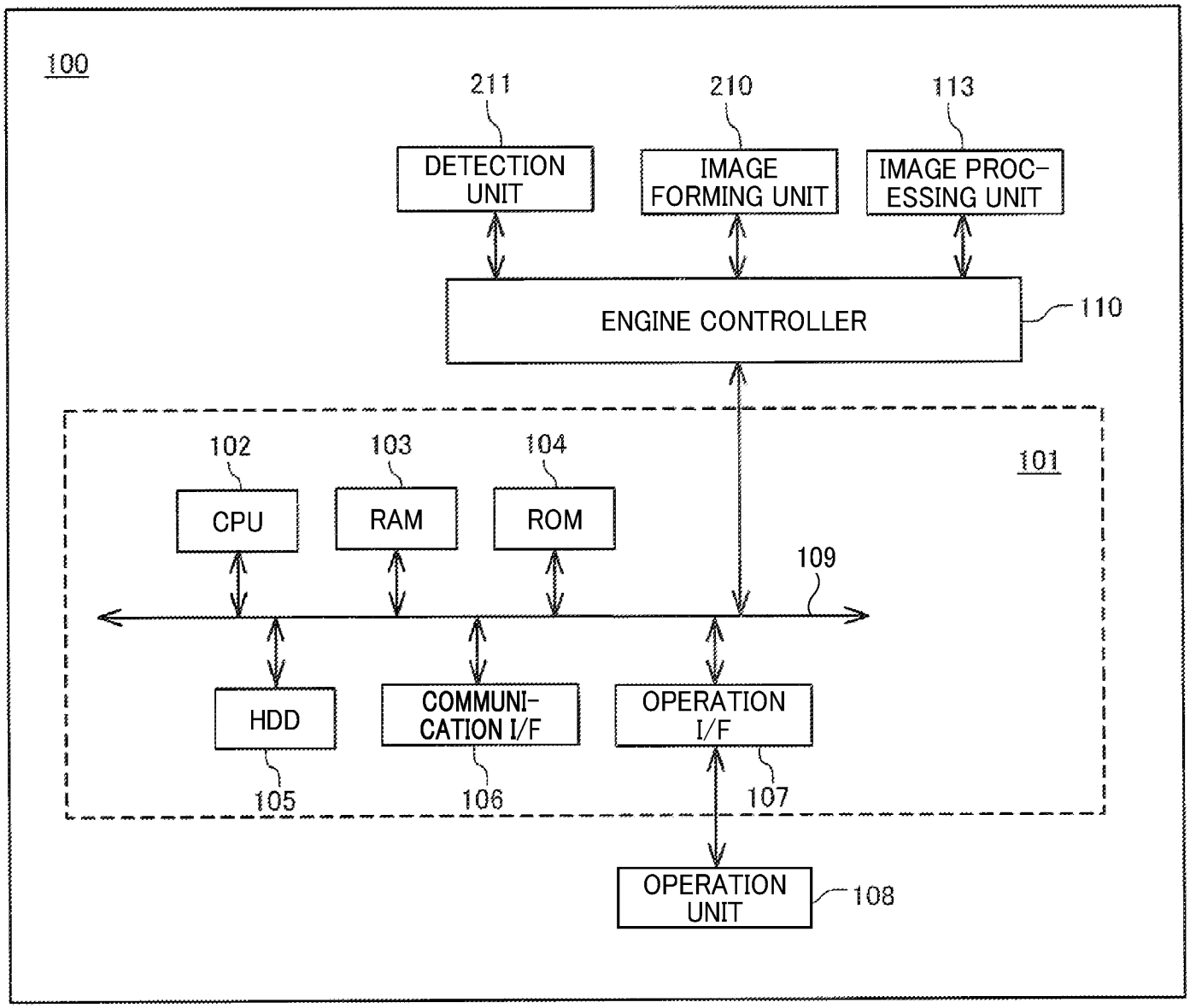
FIG. 2 is a block diagram of a section related to control of the printing apparatus.

Next, a section related to the control of the printing apparatus 100 will be described with reference to the block diagram of FIG. 2.

A control section of the printing apparatus 100 includes, e.g., a controller 101, an engine controller 110, and an image processing unit 113.

The controller 101 as control circuitry includes a central processing unit (CPU) 102, a random access memory (RAM) 103, a read only memory (ROM) 104, a hard disk drive (HDD) 105, a communication interface (I/F) 106, and an operation I/F 107. The operation I/F 107 is connected to an operation unit 108. The CPU 102, the RAM 103, the ROM 104, the HDD 105, the communication I/F 106, and the operation I/F 107 are connected to each other by a system bus 109.

The controller 101 includes a microcomputer, and the CPU 102 executes a program stored in the ROM 104 or the HDD 105 using the RAM 103 as a work area to control the entire printing apparatus 100.

The controller 101 also serves as a correcting device according to the present embodiment and calculates an amount of deviation of an image in printing output from printing and detection (reading) of a position detection mark to perform geometric correction processing to the input image.

The ROM 104 and the HDD 105 are nonvolatile storage media (storage device) and store various programs and various fixed data executed by the CPU 102.

The communication I/F 106 is an interface for connecting the printing apparatus 100 to the network.

The operation I/F 107 is an interface for connecting the operation unit 108 to the system bus 109 and enabling the operation unit 108 to be controlled from the CPU 102.

The operation unit 108 is a user interface including operation devices such as keys, buttons, and touch sensors to receive operations from a user and a display device such as a display to present information to a user.

The image processing unit 113 is an image processor that performs image processing on the image data input from the outside. In addition to the image processing unit 113, the CPU 102, the RAM 103, the ROM 104, and the HDD 105 of the controller 101 and the engine controller 110 achieve the functions of an image processing apparatus.

The engine controller 110 is a control unit that controls the image forming unit 210, the detection device 211, and the image processing unit 113 according to a command from the CPU 102 via the system bus 109.

The printing apparatus 100 reads, with the detection device 211, how the image (print output) output by the printing unit 204 is deviated from the target image to calculate the amount of deviation, and processes the image with the image processing unit 113 to correct the amount of deviation. Examples of the correction of the amount of deviation include pre-print correction in which trial printing is performed in advance to obtain the amount of deviation of an image and an image in actual printing is deformed, and the back face correction in which the correction of the back face is performed in real time relative to the image of the front face.

Figure 3B:
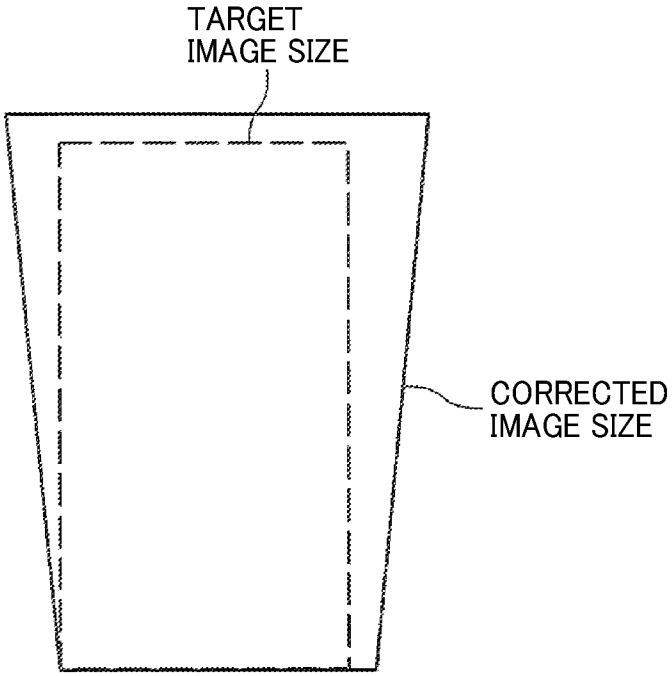
FIGS. 3A and 3B are illustrations of examples of correction of the amount of deviation.
Figure 3A:
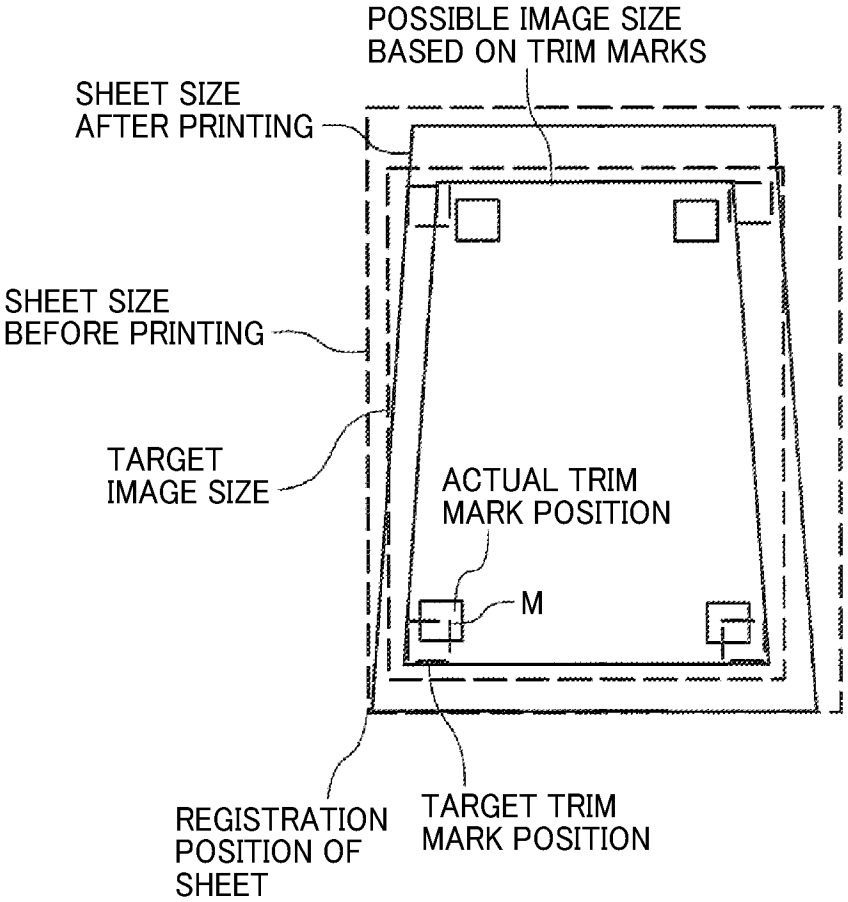

Next, an example of the correction of the amount of deviation is described with reference to FIGS. 3A and 3B. FIGS. 3A and 3B are illustrations of an example of the correction of the amount of deviation.

Here, position detection marks (hereinafter referred to as "trim marks") M are printed on the four corners of a sheet (hereinafter referred to as "paper sheet", but not limited to paper), and the amount of deviation of the coordinates of each trim mark from the target coordinates with respect to the origin of the paper sheet is calculated and corrected.

Further, as illustrated in FIG. 3A, the trim marks M are printed at four locations on the paper sheet and the position of each trim mark M, the position (origin) of an edge of the paper sheet are read, and the amount of deviation from the target position of the image with respect to the origin of the paper sheet is calculated. Then, as illustrated in FIG. 3B, an image actually printed is corrected in reverse.

As a result, the variation of the actual image size can be confirmed, and the highly accurate correction can be performed.

Figure 4:
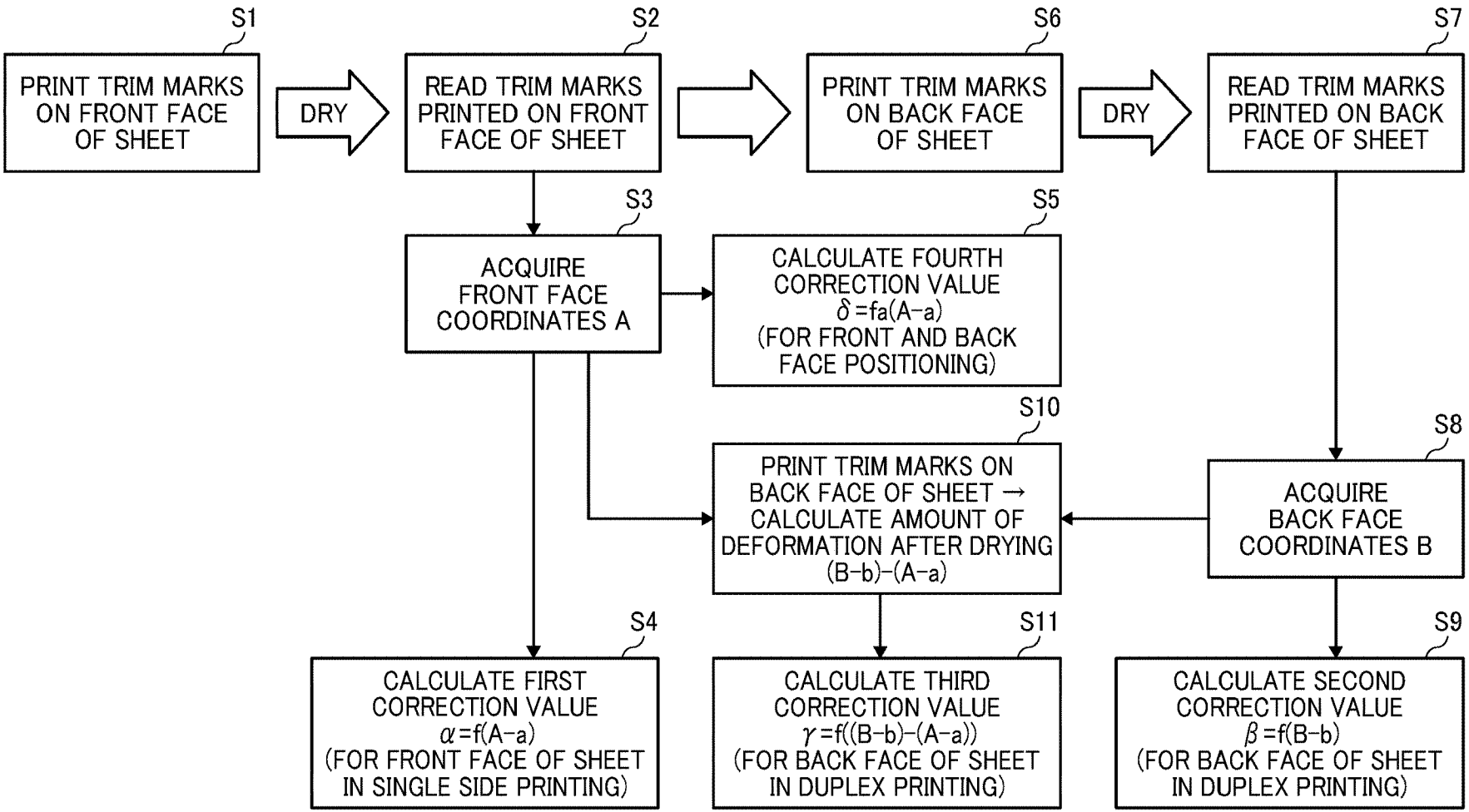
FIG. 4 is a conceptual diagram illustrating a calculation process of correction values according to the first embodiment of the present disclosure.

Next, a calculation process of correction values according to the first embodiment of the present disclosure is described with reference to FIG. 4. FIG. 4 is a conceptual diagram of the calculation process of correction values (adjustment values) according to the first embodiment.

In order to correct the image position, the amount of deformation of a printed sheet is confirmed in advance before a print job, and the correction is performed.

First, the trim marks M are printed on one face (referred to as front face) of a sheet (step S1, hereinafter simply referred to as "S1"). Then, the trim marks M printed on the one face of the sheet are read (S2), and the position (referred to as "front face coordinates") A of each trim mark M in the single-side printing is acquired (S3).

The difference (A−a) between acquired front face coordinates A of a trim mark M in the single-side printing and the target position (hereinafter referred to as "ideal position") a of the trim marks M is substituted into the correction value calculation algorithm function f(X), and a first correction value $\alpha=f(A-a)$ is calculated (S4). The calculated first correction value $\alpha$ is stored in the RAM 103. The first correction value $\alpha$ is a correction value (adjustment value) used when the single-side printing is performed. The first correction value $\alpha$ is read from the RAM 103 and used when the printing is actually performed.

Further, the difference (A−a) between acquired front face coordinates A of a trim mark M in the single-side printing and the target position (hereinafter, referred to as "ideal position") a of the trim mark M is substituted into the correction value calculation algorithm function fa(X) for front and back face positioning, and a fourth correction value $\delta=fa(A-a)$ is calculated (S5).

The fourth correction value $\delta$ is a correction value (adjustment value) used when the front face and the back face of the sheet are positioned in real time.

Then, an image for the other face (referred to as back face) of the sheet is deformed using the fourth correction value $\delta$, and the trim marks M are printed (S6) on the back face.

As a result, the images on the front and back faces can be printed in agreement with each other, and the relative positions of each trim mark M between the front face and the back face coincide with the ideal position.

Then, the trim marks M printed on the back face are read (S7), and the positions (referred to as "back face coordinates") B of the trim marks M on the back face after the duplex printing is acquired (S8).

The difference (B-b) between acquired back face coordinates B of a trim mark M in the duplex printing and the ideal position b of the trim mark M is substituted into the correction value calculation algorithm function f(X), and a second correction value $\beta=f(B-b)$ is calculated (S9). The calculated second correction value $\beta$ is stored in the RAM 103. In the present embodiment, the second correction value $\beta$ is a correction value (adjustment value) when printing is performed on one face (front face) in duplex printing. The second correction value $\beta$ is read from the RAM 103 and used when the printing is actually performed.

Further, the difference (A−a) between the front face coordinates A of the trim mark M and the ideal coordinates a in the front face printing is the amount of deformation when printing is performed on the front face, and the difference (B−b) between the back face coordinates B of the trim mark M and the ideal coordinates b in the back face printing is the amount of deformation of the front face in the duplex printing (S10).

As a result, (B−b)−(A−a) is the amount of deformation of the back face when printing is performed on the back face after the front face printing, and (B−b)−(A−a) is substituted into the correction value calculation algorithm function f(X), and a third correction value $\gamma=f((B-b)-(A-a))$ is calculated (S11). The calculated third correction value $\gamma$ is stored in the ROM 104. In the present embodiment, the third correction value $\gamma$ is a correction value (adjustment value) when printing is performed on the other face (back face) in the duplex printing. The third correction value $\gamma$ is read from the ROM 104 and used when the printing is actually performed.

Thus, it is not necessary to print for each correction value, and three correction values can be calculated in one time duplex printing, and waste paper sheets for adjustment can be reduced.

At this time, the correction values $\alpha$, $\beta$, and $\gamma$ may be obtained by passing one sheet. Alternatively, a plurality of sheets may be passed to cancel reading variations and printing variations, and the average value may be calculated to determine the correction value.

Figure 5:
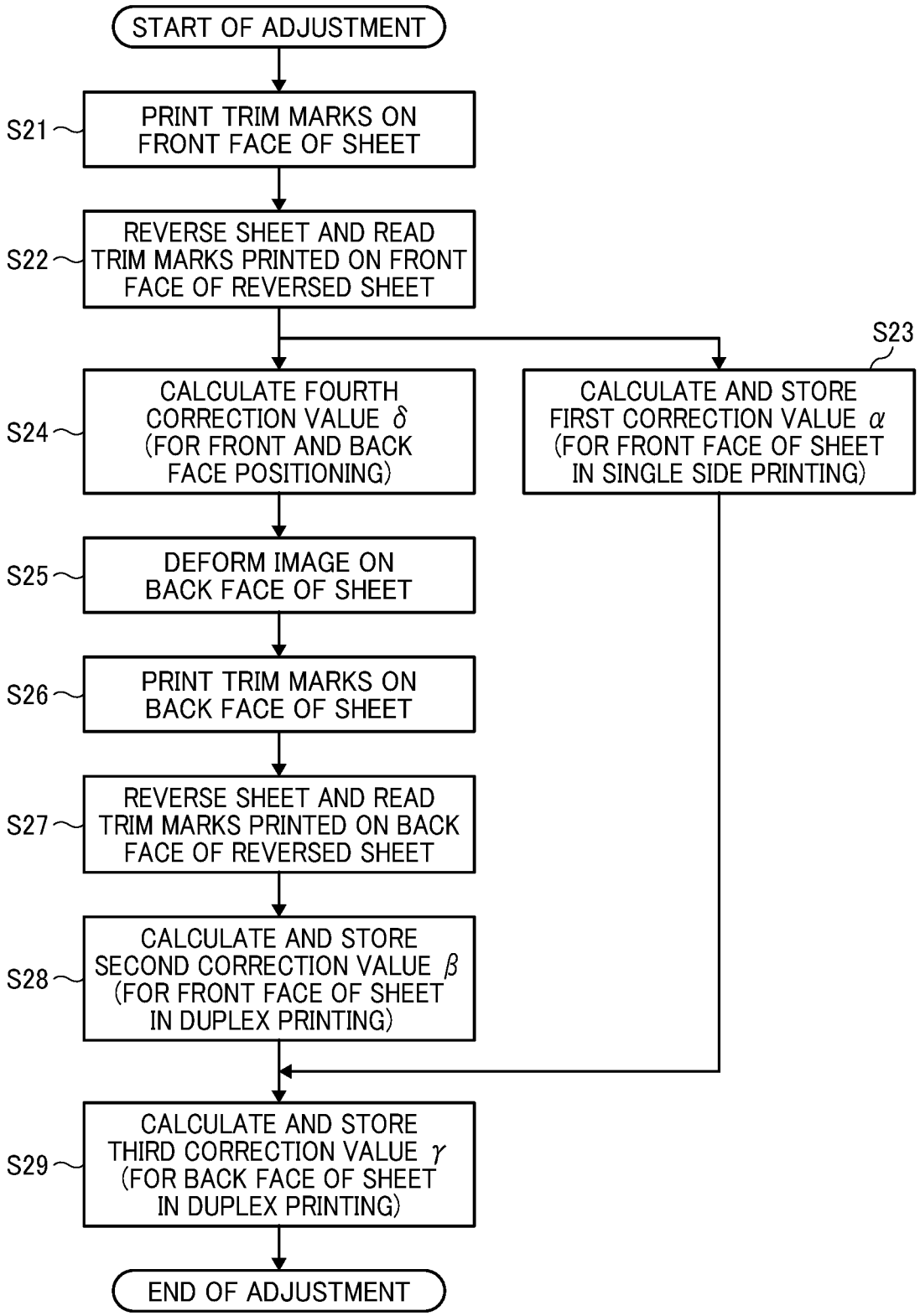
FIG. 5 is a flowchart illustrating a calculation process of correction values in the first embodiment.

Next, a calculation process of correction values (adjustment values) is described with reference to the flowchart of FIG. 5.

The trim marks Mare printed on one face (front face) of the sheet (S21). The front face is read after the sheet is reversed (S22). Then, the front face coordinates A of a trim mark M in single-side printing are acquired, and the first correction value $\alpha$ (adjustment value) that is used when printing is performed on the front face in the single-side printing is calculated and stored (S23).

Further, the fourth correction value $\delta$ (adjustment value) is calculated that is used when the front face and the back face are positioned in real time based on the difference (A−a) between the acquired front face coordinates A of the trim mark M and the ideal position a of the trim mark M, and printing is performed on the back face (S24).

Then, an image for the other face (back face) of the sheet is deformed using the fourth correction value $\delta$ on (S25), and the trim marks M are printed on the back face (S26). The front face of the sheet is read after the sheet is reversed (S27).

Then, the back face coordinates B of the trim mark M are acquired, and the second correction value $\beta$ (adjustment value), which is used when printing is performed on one face (front face) in duplex printing, is calculated and stored (S28).

Next, the adjustment value, which is the third correction value $\gamma$ used when printing is performed on the other face (back face) in duplex printing, is calculated and stored (S29).

Figure 6:
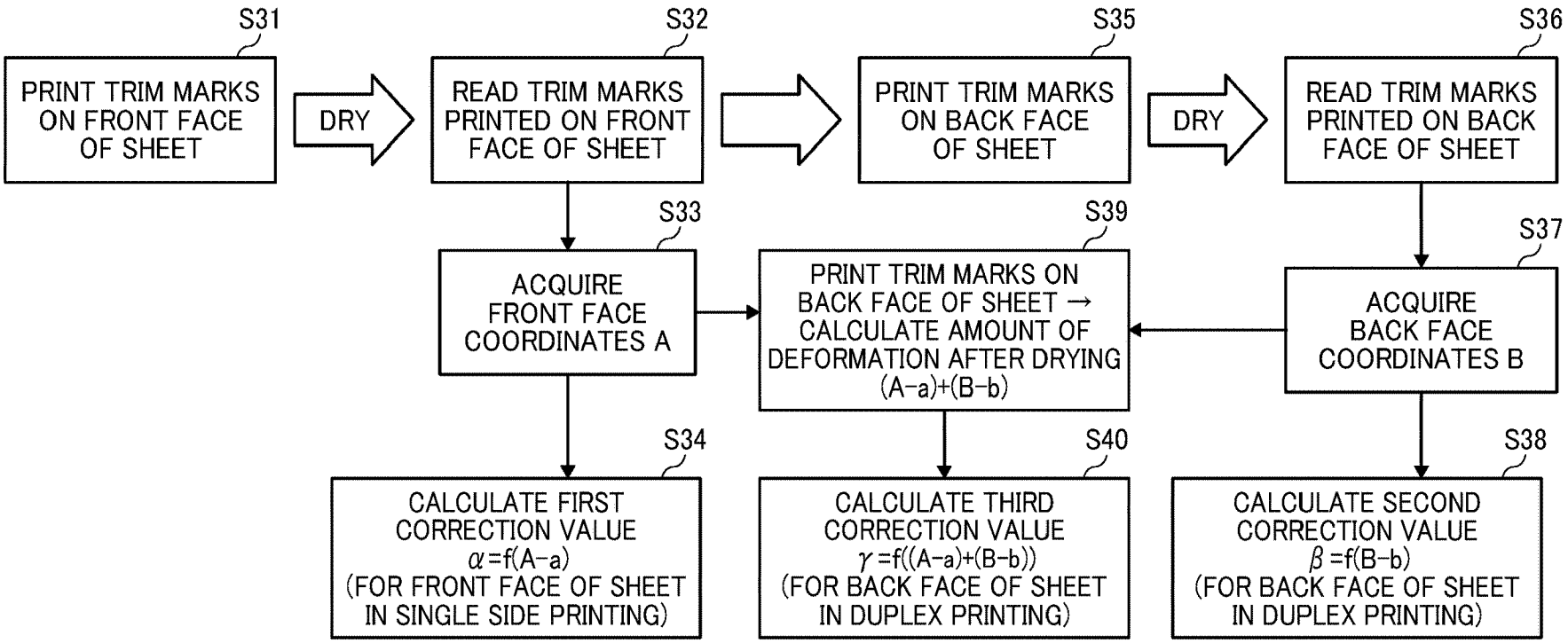
FIG. 6 is a conceptual diagram illustrating a calculation process of correction values according to a second embodiment of the present disclosure.

Next, a calculation process of correction values according to a second embodiment of the present disclosure is described with reference to FIG. 6. FIG. 6 is a conceptual diagram of the calculation process of correction values (adjustment values) according to the second embodiment.

In steps S31 to S34, as in the steps S to S4 in the first embodiment, printing is performed on one face (front face) of a sheet, and the first correction value α is calculated and stored.

Then, trim marks M are printed at the target positions on the other face (back face) of the sheet (S35). After printing is performed in duplex printing, the trim marks M printed on the back face are read (S36), and the coordinates B of the trim marks M on the back face after the duplex printing are acquired (S37).

Next, the difference (B−b) between the ideal position b of the trim mark M on the back face and the back face coordinates B is the amount of deformation by the back face printing after the front face printing. The difference (B−b) is substituted into the correction value calculation algorithm function f(X), and the second correction value β=f(B−b) is calculated (S38). The calculated second correction value β is stored in the RAM 103. In the present embodiment, the second correction value β is a correction value (adjustment value) when printing is performed on the other face (back face) in duplex printing. The second correction value β is read from the RAM 103 and used when the printing is actually performed.

Further, the difference (A−a) between the front face coordinates A and the ideal coordinates a is the amount of deformation caused when printing is performed on the front face, and the difference (B−b) between the back face coordinates B and the ideal coordinates b is the amount of deformation caused when printing is performed on the back face after the front face printing (S39).

Therefore, (A−a)+(B−b) is the amount of deformation of the front face in the duplex printing, and (A−a)+(B−b) is substituted into the correction value calculation algorithm function f(X), and the third correction value γ=f((A−a)+(B−b)) is calculated (S40). The calculated third correction value γ is stored in the RAM 103. In the present embodiment, the third correction value γ is a correction value (adjustment value) when printing is performed on one face (front face) in duplex printing. The third correction value γ is read from the RAM 103 and used when the printing is actually performed.

Thus, it is not necessary to print for each correction value, three correction values can be calculated in one time duplex printing, and waste paper sheets for adjustment can be reduced.

In the above-described embodiments, image forming, recording, copying, printing, modeling, and the like can be all used as synonyms.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A printing apparatus, comprising:

a printing device configured to print, on a sheet, a detection mark for acquiring an amount of deviation of an image generated when printing is performed;

a detection device configured to read a position of the detection mark and acquire the amount of deviation of the position of the detection mark; and control circuitry configured to perform correction according to the amount of deviation when printing is performed, wherein the control circuitry is configured to:

print the detection mark on each of a first face and a second face of the sheet with the printing device in a duplex printing;

read the detection mark of each of the first face and the second face with the detection device;

calculate a first correction value from the position of the detection mark on the first face on which printing is performed first;

calculate a second correction value from the position of the detection mark on the second face on which printing is performed after the first face; and calculate a third correction value from the position of the detection mark on the first face and the position of the detection mark on the second face, calculate a fourth correction value from a difference between a target position and a reading position of the detection mark printed on the first face.

2. The printing apparatus according to claim 1, wherein the control circuitry is configured to perform the correction with the first correction value when a single side printing is performed.

3. The printing apparatus according to claim 1, wherein the control circuitry is configured to:

calculate the first correction value from a difference between a target position and a reading position of the detection mark printed on the first face; and calculate the second correction value from a difference between a target position and a reading position of the detection mark printed on the second face.

4. The printing apparatus according to claim 3, wherein the control circuitry is configured to perform the correction with the second correction value when printing is performed on the second face in the duplex printing.

5. The printing apparatus according to claim 3, wherein the control circuitry is configured to calculate the third correction value from a sum of the difference between the target position and the reading position of the detection mark printed on the second face and the difference between the target position and the reading position of the detection mark printed on the first face.

6. The printing apparatus according to claim 5, wherein the control circuitry is configured to perform the correction with the third correction value when printing is performed on the first face in the duplex printing.

7. The printing apparatus according to claim 1, wherein the control circuitry is configured to:

calculate the first correction value from a difference between a target position and a reading position of the detection mark printed on the first face;

print the detection mark on the second face with the fourth correction value; and calculate the second correction value from a difference between a target position and a reading position of the detection mark printed on the second face with the fourth correction value.

8. The printing apparatus according to claim 1, wherein the control circuitry is configured to:

calculate the first correction value from a difference between a target position and a reading position of the detection mark printed on the first face;

print the detection mark on the second face; and calculate the second correction value from a difference between a target position and a reading position of the detection mark printed on the second face.

9. The printing apparatus according to claim 8, wherein the control circuitry is configured to perform the correction with the second correction value when printing is performed on the first face in the duplex printing.

10. The printing apparatus according to claim 8, wherein the control circuitry is configured to calculate the third correction value from a sum of a difference between a target position and a reading position of the detection mark printed on the second face and a difference between a target position and a reading position of the detection mark printed on the first face.

11. The printing apparatus according to claim 10, wherein the control circuitry is configured to perform the correction with the third correction value when printing is performed on the second face in the duplex printing.

12. A printing apparatus, comprising:

a printing device configured to print, on a sheet, a detection mark for acquiring an amount of deviation of an image generated when printing is performed;

a detection device configured to read a position of the detection mark and acquire the amount of deviation of the position of the detection mark; and control circuitry configured to perform correction according to the amount of deviation when printing is performed, wherein the control circuitry is configured to:

print the detection mark on each of a first face and a second face of the sheet with the printing device in trial duplex printing;

read the detection mark of each of the first face and the second face with the detection device;

calculate a first correction value for actual single side printing from the position of the detection mark on the first face on which printing is performed first;

calculate a second correction value for the first face of actual duplex printing from the position of the detection mark on the second face on which printing is performed after the first face; and calculate a third correction value for the second face of the actual duplex printing from the position of the detection mark on the first face and the position of the detection mark on the second face, the third correction value being calculated from a sum of a difference between a target position and a reading position of the detection mark printed on the second face in the trial duplex printing and a difference between a target position and a reading position of the detection mark printed on the first face in the trial duplex printing.

13. The printing apparatus according to claim 12, wherein the control circuitry is configured to:

read the detection mark of the first face after the trial duplex printing;

calculate a correction value $\alpha$ of the first face for the single side printing and a correction value $\delta$ of the second face for the duplex printing;

read the detection mark of the second face after the trial duplex printing to which the correction value $\delta$ is applied; and calculate a correction value $\beta$ of the first face for the duplex printing and a correction value $\gamma$ of the second face for the duplex printing using the difference between the correction value $\beta$ and the correction value $\alpha$.

* * * * *